US012320535B2

(12) United States Patent
Ueda et al.

(10) Patent No.: US 12,320,535 B2
(45) Date of Patent: Jun. 3, 2025

(54) AIR-CONDITIONING APPARATUS

(71) Applicant: Mitsubishi Electric Corporation, Tokyo (JP)

(72) Inventors: Shunji Ueda, Tokyo (JP); Kota Nagano, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 169 days.

(21) Appl. No.: 18/044,589

(22) PCT Filed: Nov. 17, 2020

(86) PCT No.: PCT/JP2020/042844

§ 371 (c)(1),
(2) Date: Mar. 9, 2023

(87) PCT Pub. No.: WO2022/107220

PCT Pub. Date: May 27, 2022

(65) Prior Publication Data

US 2023/0332787 A1 Oct. 19, 2023

(51) Int. Cl.
*F24F 11/36* (2018.01)
*F24F 13/20* (2006.01)

(52) U.S. Cl.
CPC ..... *F24F 11/36* (2018.01); *F24F 13/20* (2013.01); *F25B 2500/222* (2013.01)

(58) Field of Classification Search
CPC ..... F24F 11/36; F24F 13/20; F25B 2500/222
See application file for complete search history.

(56) References Cited

U.S. PATENT DOCUMENTS

2017/0343258 A1 11/2017 Yamaguchi et al.

FOREIGN PATENT DOCUMENTS

| | | | |
|---|---|---|---|
| EP | 3 719 405 | A1 | 10/2020 |
| JP | 2005-147487 | A | 6/2005 |
| JP | 2017-015324 | A | 1/2017 |
| JP | 2019-138556 | A | 8/2019 |
| JP | 2020-169798 | A | 10/2020 |

(Continued)

OTHER PUBLICATIONS

JP 2017/015324 (English Translation) (Year: 2017).*

(Continued)

*Primary Examiner* — Jonathan Bradford
(74) *Attorney, Agent, or Firm* — Posz Law Group, PLC

(57) ABSTRACT

An air-conditioning apparatus includes: a refrigerant circuit; a casing configured to accommodate therein a heat exchanger and an internal refrigerant pipe, the heat exchanger and the internal refrigerant pipe each forming a part of the refrigerant circuit; a refrigerant pipe connection portion; an opening port formed on the casing, and configured to allow an interior of the casing to communicate with an exterior of the casing; a cover portion configured to cover a periphery of the refrigerant pipe connection portion, and cover, the opening port; and a refrigerant sensing unit provided in a refrigerant leakage sensing space, the refrigerant leakage sensing space being made up of an outside space of the casing and an inside space of the casing, the outside space being covered by the cover portion, the inside space communicating with the outside space through the opening port.

9 Claims, 7 Drawing Sheets

(56) References Cited

FOREIGN PATENT DOCUMENTS

| | | | |
|---|---|---|---|
| WO | 2016/151642 | A1 | 9/2016 |
| WO | 2020/059006 | A1 | 3/2020 |

OTHER PUBLICATIONS

Extended European Search Report dated Dec. 4, 2023 issued in corresponding European Patent Application No. 20962384.2.
International Search Report of the International Searching Authority mailed Feb. 2, 2021 in corresponding International application No. PCT/JP2020/042844 (and English translation).
Office Action dated Aug. 8, 2023 issued in corresponding JP patent application No. 2022-563285 (and English translation).

* cited by examiner

AIR-CONDITIONING APPARATUS

CROSS REFERENCE TO RELATED APPLICATION

This application is a U.S. national stage application of PCT/JP2020/042844 filed on Nov. 17, 2020 the contents of which are incorporated herein by reference.

TECHNICAL FIELD

The present disclosure relates to an air-conditioning apparatus including a refrigerant sensing unit to sense refrigerant leakage.

BACKGROUND ART

There are air-conditioning apparatuses known which heat or cool room air by a heat exchanger using refrigerant. A flammable refrigerant or a mildly flammable refrigerant may be used. If such a refrigerant leaks, it may lead to a fire. Patent Literature 1 discloses an air-conditioning apparatus provided with a refrigerant sensing unit. The refrigerant sensing unit is provided in a casing of an indoor unit of the air-conditioning apparatus, so that if refrigerant leaks in the casing, the refrigerant sensing unit can immediately sense the leakage.

CITATION LIST

Patent Literature

Patent Literature 1: Japanese Unexamined Patent Application Publication No. 2019-138556

SUMMARY OF INVENTION

Technical Problem

The air-conditioning apparatus includes a refrigerant circuit to allow refrigerant to circulate therein. The refrigerant circuit has a configuration in which a compressor, a heat-source-side heat exchanger, a pressure reducing device, and a load-side heat exchanger are connected in a ring form through refrigerant pipes. A part of the refrigerant circuit including the heat-source-side heat exchanger is accommodated in an outdoor unit, while another part of the refrigerant circuit including the load-side heat exchanger is accommodated in an indoor unit. An extension pipe forming a part of the refrigerant circuit is provided between the outdoor unit and the indoor unit. This extension pipe connects to the refrigerant pipe running through the interior of the indoor unit, while connecting to the refrigerant pipe running through the interior of the outdoor unit.

In the indoor unit (or the outdoor unit) of the air-conditioning apparatus, a refrigerant pipe connection portion through which an internal refrigerant pipe connects to an external extension pipe may be located inside the casing of the indoor unit (or the outdoor unit) in some cases, or otherwise located outside the casing.

In such a configuration that the refrigerant pipe connection portion is located inside the casing of the indoor unit (or the outdoor unit), if refrigerant leaks from the refrigerant pipe connection portion, the air-conditioning apparatus provided with the refrigerant sensing unit in the casing as disclosed in Patent Literature 1 can immediately sense the refrigerant leakage. However, in a configuration in which the refrigerant pipe connection portion is located outside the casing of the indoor unit (or the outdoor unit), if refrigerant leaks from the refrigerant pipe connection portion, the leaking refrigerant spreads to the exterior of the casing. This results in a problem that the air-conditioning apparatus provided with the refrigerant sensing unit in the casing as disclosed in Patent Literature 1 cannot immediately sense the refrigerant leakage.

It is therefore an object of the present disclosure to provide an air-conditioning apparatus in which a refrigerant pipe connection portion is located outside a casing of an indoor unit (or an outdoor unit), and if refrigerant leaks from the refrigerant pipe connection portion, the air-conditioning apparatus can immediately sense the refrigerant leakage.

Solution to Problem

An air-conditioning apparatus according to an embodiment of the present disclosure includes: a refrigerant circuit configured to allow refrigerant to circulate therein; a casing configured to accommodate therein a heat exchanger and an internal refrigerant pipe, the heat exchanger and the internal refrigerant pipe each forming a part of the refrigerant circuit; a refrigerant pipe connection portion provided on an outside of one side portion of the casing, and configured to connect the internal refrigerant pipe and an external refrigerant pipe; an opening port formed on the casing, and configured to allow an interior of the casing to communicate with an exterior of the casing; a cover portion configured to cover a periphery of the refrigerant pipe connection portion, and cover, from outside of the casing, the opening port; and a refrigerant sensing unit provided in a refrigerant leakage sensing space, and configured to sense leakage of the refrigerant, the refrigerant leakage sensing space being made up of an outside space of the casing and an inside space of the casing, the outside space being covered by the cover portion, the inside space communicating with the outside space through the opening port.

Advantageous Effects of Invention

The air-conditioning apparatus according to an embodiment of the present disclosure has a configuration in which the refrigerant pipe connection portion is located outside the casing of the indoor unit (or the outdoor unit). In this configuration, if refrigerant leaks from the refrigerant pipe connection portion, the refrigerant leakage can be immediately sensed.

DESCRIPTION OF EMBODIMENTS

Figure 1:
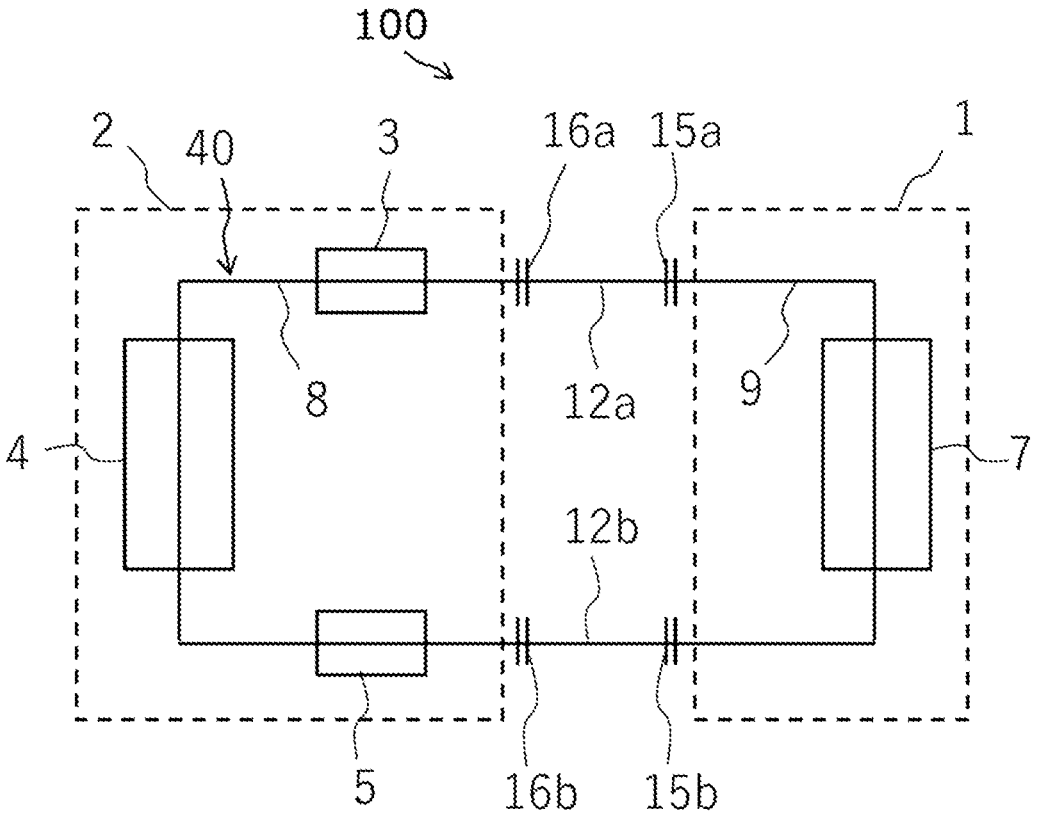
FIG. 1 is a refrigerant circuit diagram illustrating the schematic configuration of an air-conditioning apparatus according to an embodiment.

An air-conditioning apparatus 100 according to an embodiment is described below. FIG. 1 is a refrigerant circuit diagram illustrating the schematic configuration of an air-conditioning apparatus 100. As illustrated in FIG. 1, the air-conditioning apparatus 100 includes a refrigerant circuit 40 to allow refrigerant to circulate therein. The refrigerant circuit 40 has a configuration in which a compressor 3, a heat-source-side heat exchanger 4, a pressure reducing device 5, and a load-side heat exchanger 7 are connected to each other in a ring form through refrigerant pipes.

A part of the refrigerant circuit 40 including the compressor 3, the heat-source-side heat exchanger 4, and the pressure reducing device 5 is accommodated in an outdoor unit 2. Another part of the refrigerant circuit 40 including the load-side heat exchanger 7 is accommodated in an indoor unit 1. Extension pipes 12*a* and 12*b* forming a part of the refrigerant circuit 40 are provided between the indoor unit 1 and the outdoor unit 2. The extension pipes 12*a* and 12*b* connect to an internal refrigerant pipe 9 at refrigerant pipe connection portions 15*a* and 15*b*. The internal refrigerant pipe 9 runs through the interior of the indoor unit 1. The extension pipes 12*a* and 12*b* also connect to a refrigerant pipe 8 at refrigerant pipe connection portions 16*a* and 16*b*. The refrigerant pipe 8 runs through the interior of the outdoor unit 2.

Figure 2:
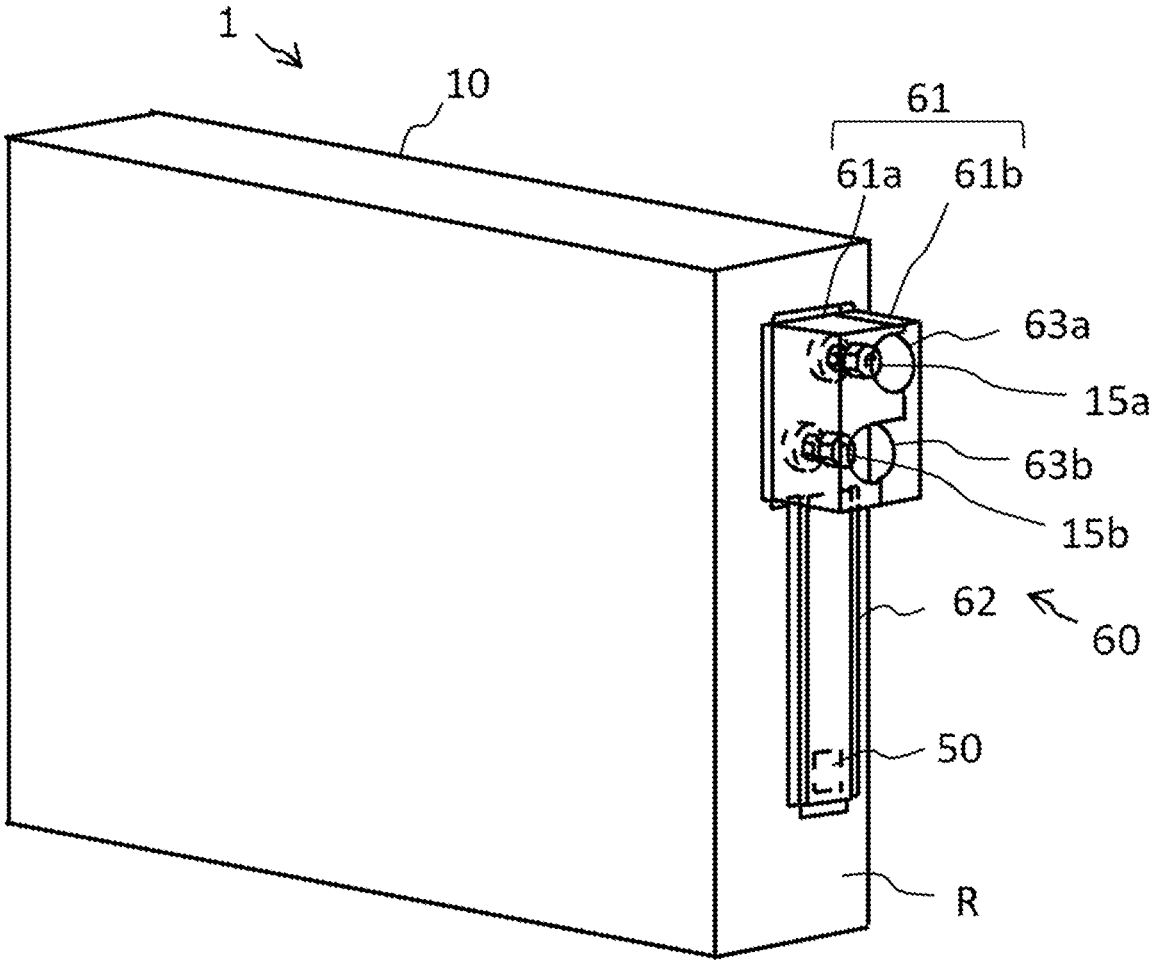
FIG. 2 is a perspective view illustrating the external configuration of an indoor unit of the air-conditioning apparatus according to the embodiment.
Figure 3:
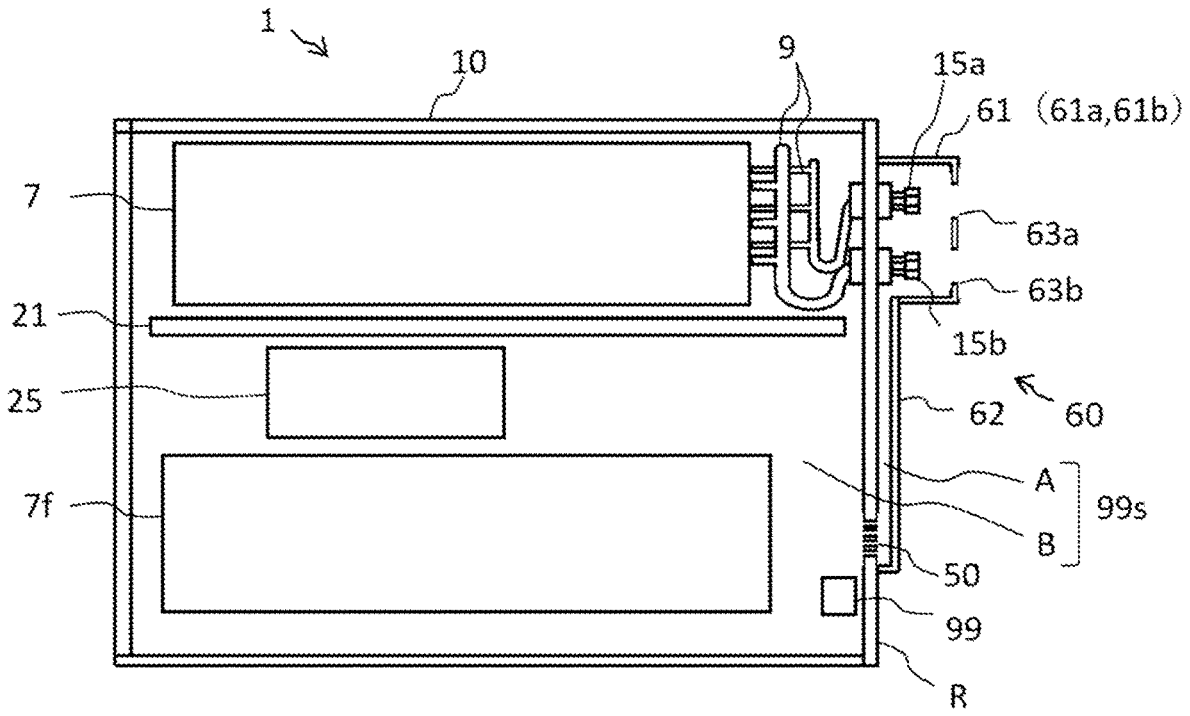
FIG. 3 is a front view schematically illustrating the structure of the indoor unit of the air-conditioning apparatus according to the embodiment.

The indoor unit 1 is described below. FIG. 2 is a perspective view illustrating the exterior configuration of the indoor unit 1. FIG. 3 is a front view schematically illustrating the structure of the indoor unit 1. As illustrated in FIGS. 2 and 3, the indoor unit 1 includes a casing 10 that is a cuboid casing. In the casing 10, the load-side heat exchanger 7 and the internal refrigerant pipe 9 are accommodated. The load-side heat exchanger 7 is a heat exchanger forming a part of the refrigerant circuit 40. Below the load-side heat exchanger 7, a drain pan 21 is provided to receive water condensed on the surface of the load-side heat exchanger 7.

Also in the casing 10, a control box 25, a fan 7*f*, and a refrigerant sensing unit 99 are accommodated. In the control box 25, electrical components such as an electronic circuit board are accommodated. The fan 7*f* generates a flow of air to an airflow passage running through the load-side heat exchanger 7. The refrigerant sensing unit 99 is configured to sense refrigerant leakage. The refrigerant sensing unit 99 is provided at a position near the bottom of the casing 10 and in close proximity to a side portion R of the casing 10 on which the refrigerant pipe connection portions 15*a* and 15*b* are provided. The refrigerant pipe connection portions 15*a* and 15*b* will be described later. For example, the refrigerant sensing unit 99 senses the concentration of refrigerant in the air around the refrigerant sensing unit 99, and outputs a sensing signal to a control unit (not illustrated). The control unit performs the processing such as sounding an alarm when the refrigerant sensing unit 99 senses leakage of refrigerant.

The side portion R is one side portion of the casing 10. On the outside of the side portion R, the refrigerant pipe connection portions 15*a* and 15*b* (for example, flare joints) are provided to connect the internal refrigerant pipe 9 and the extension pipes 12*a* and 12*b*. The extension pipes 12*a* and 12*b* are external refrigerant pipes. An opening port 50 is formed at a position below the refrigerant pipe connection portions 15*a* and 15*b* provided on the side portion R, and above and near the refrigerant sensing unit 99. The opening port 50 allows the interior of the casing 10 to communicate with the exterior of the casing 10. The opening port 50 has a plurality of small holes formed therein, through which the interior of the casing 10 communicates with the exterior of the casing 10. Note that the number of holes that make up the opening port 50, and the shape of the holes are not limited to the example illustrated in the drawings. It suffices that there is one or more holes. The holes may have any shape such as a slit shape.

On the outside of the side portion R of the casing 10, a cover portion 60 is provided to cover peripheries of the refrigerant pipe connection portions 15*a* and 15*b*, and to cover the outside of the casing 10 with the opening port 50. In this manner, a refrigerant leakage sensing space 99*s* is formed as illustrated in FIG. 3. The refrigerant leakage sensing space 99*s* is made up of an outside space A of the casing 10 and an inside space B of the casing 10. The outside space A is covered by the cover portion 60. The inside space B communicates with the outside space A through the opening port 50. In the refrigerant leakage sensing space 99*s*, if refrigerant leaks from the refrigerant pipe connection portions 15*a* and 15*b*, the leakage can be immediately sensed. The refrigerant sensing unit 99 is provided in this refrigerant leakage sensing space 99*s*. FIG. 3 illustrates an example in which the refrigerant sensing unit 99 is provided in the inside space B of the casing 10 within the refrigerant leakage sensing space 99*s*.

The cover portion 60 has a structure made up of a first part 61 and a second part 62. The first part 61 is configured to cover peripheries of the refrigerant pipe connection portions 15*a* and 15*b*. The second part 62 is configured to cover the outside of the casing 10 with the opening port 50. These first part 61 and second part 62 are combined and attached to the casing 10 in such a manner that the space formed by the first part 61 and the space formed by the second part 62 communicate with each other. The outside space A of the casing 10, covered by the cover portion 60 described above, refers to the entire space made up of the space formed by the first part 61 and the space formed by the second part 62, these spaces communicating with each other. Note that the cover portion 60 can be made of metal, resin or other material.

Figure 4:
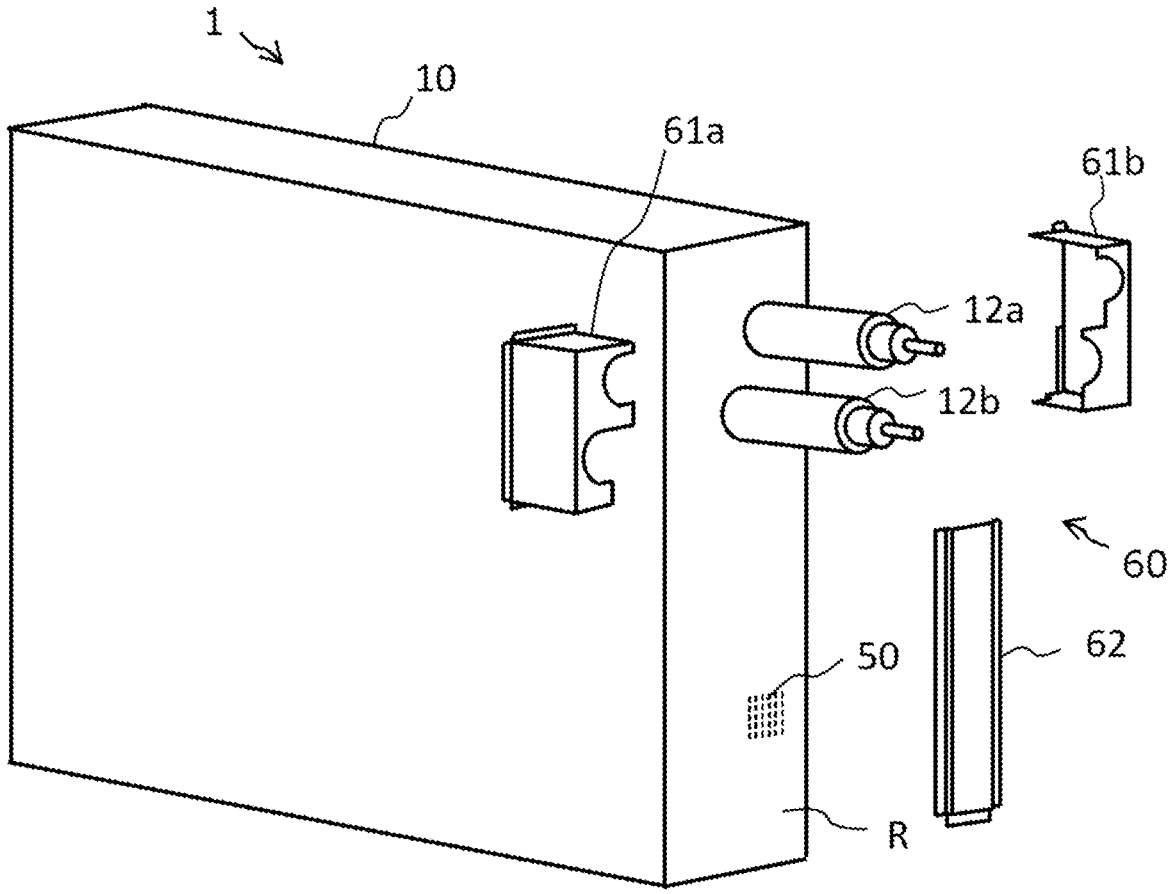
FIG. 4 illustrates the indoor unit of the air-conditioning apparatus according to the embodiment before a cover portion is attached to a casing.
Figure 5:
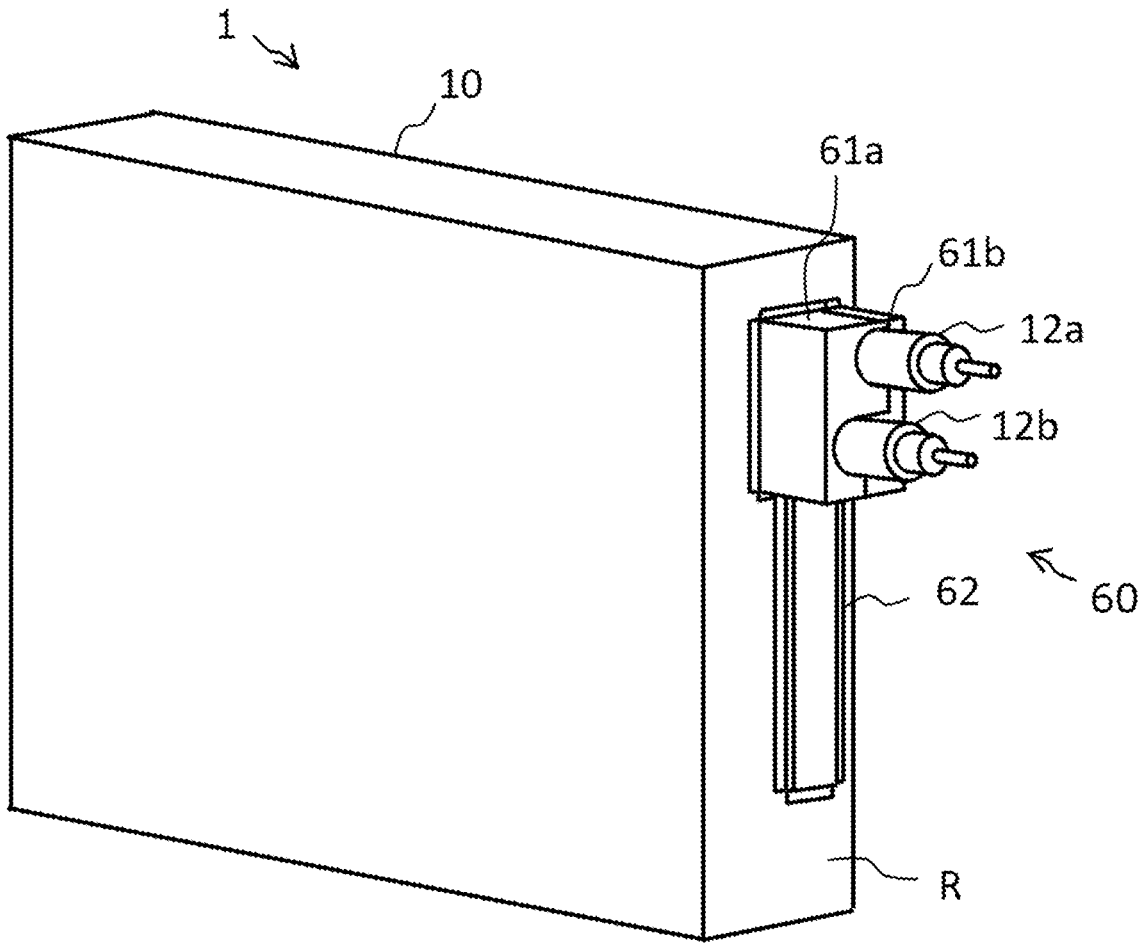
FIG. 5 illustrates the indoor unit of the air-conditioning apparatus according to the embodiment with the cover portion attached to the casing.
Figure 6:
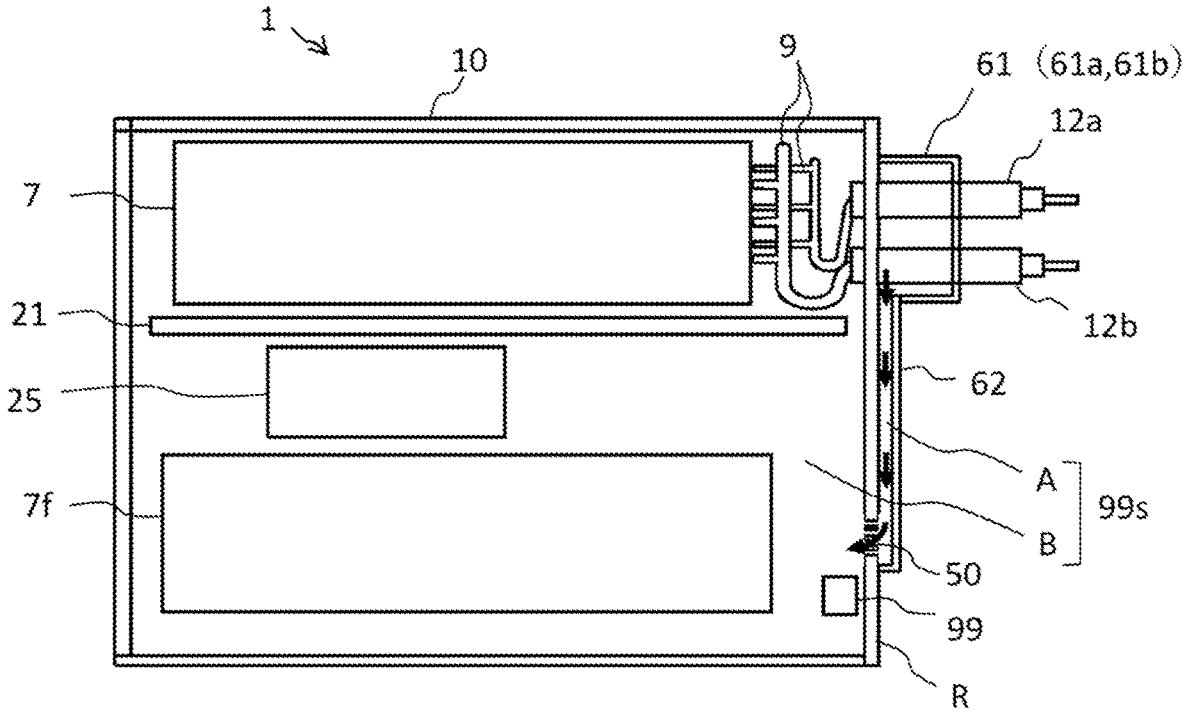
FIG. 6 is a front view schematically illustrating the indoor unit of the air-conditioning apparatus according to the embodiment with the cover portion attached to the casing.

FIG. 4 illustrates the indoor unit 1 before the cover portion 60 is attached to the casing 10. FIG. 4 also illustrates the indoor unit 1 with the extension pipes 12*a* and 12*b* connected to the refrigerant pipe connection portions 15*a* and 15*b*. FIG. 5 illustrates the indoor unit 1 with the cover portion 60 attached to the casing 10. FIG. 6 is a front view schematically illustrating the indoor unit 1 with the cover portion 60 attached to the casing 10.

The second part 62 is a vertically elongated part attached to the side portion R of the casing 10 with its open upper end portion connected to the first part 61 and with the other end portions all closed. This second part 62 is located in such a manner as to cover the outside of the casing 10 with the opening port 50 with a predetermined spacing from the casing 10. The second part 62 may be attached to the casing 10 by welding or by fixing using removable screws or other means.

The first part 61 is attached to the side portion R of the casing 10, and covers peripheries of the refrigerant pipe connection portions 15*a* and 15*b* to form a box-shaped space. The first part 61 is provided with through opening ports 63*a* and 63*b* through which the extension pipes 12*a* and 12*b* extend. The first part 61 is made up of a left cover 61*a* and a right cover 61*b* that are divided into left and right from the section through which the extension pipes 12*a* and 12*b* penetrate. The left cover 61*a* and the right cover 61*b* are combined in such a manner as to cover the extension pipes 12*a* and 12*b*, and are attached to the side portion R of the casing 10. Thus, the first part 61 can form the space in which its lower portion is opened, connecting to the second part 62, while the other portions of the first part 61 are all closed.

The left cover 61*a* and the right cover 61*b* are attached to the casing 10 by means of fixing using removable screws or other means. This allows either one or both of the left cover 61*a* and the right cover 61*b* to be removed temporarily in the process of connecting or removing the extension pipes 12*a* and 12*b* to or from the refrigerant pipe connection portions 15*a* and 15*b*, and thus can facilitate the process of connecting the extension pipes 12*a* and 12*b* and other processes.

In the configuration of the cover portion 60 described above, if refrigerant leaks from the refrigerant pipe connection portions 15*a* and 15*b* due to, for example, improper connection of the extension pipes 12*a* and 12*b*, the leaking refrigerant is first contained in the space formed by the first part 61. Thereafter, the leaking refrigerant flows through the space formed by the second part 62 and spreads to the interior of the casing 10 from the opening port 50 as illustrated by the arrows in FIG. 6. When the leaking refrigerant flows into the casing 10, the refrigerant sensing unit 99 provided in the casing 10 can sense the leakage of the refrigerant. Particularly, in the present embodiment, the refrigerant sensing unit 99 is located near and below the opening port 50, and therefore can relatively quickly sense the leaking refrigerant flowing into the casing 10 from the opening port 50.

As explained above, the air-conditioning apparatus 100 includes the refrigerant circuit 40 configured to allow refrigerant to circulate therein, and the casing 10 configured to accommodate therein the load-side heat exchanger 7 (heat exchanger) and the internal refrigerant pipe 9. The load-side heat exchanger 7 forms a part of the refrigerant circuit 40. The air-conditioning apparatus 100 further includes the refrigerant pipe connection portions 15*a* and 15*b* provided on the outside of one side portion of the casing 10 and configured to connect the internal refrigerant pipe 9 and the extension pipes 12*a* and 12*b*, the extension pipes 12*a* and 12 being external refrigerant pipes. The air-conditioning apparatus 100 still further includes the opening port 50 and the cover portion 60. The opening port 50 is formed on the casing 10 and configured to allow the interior of the casing 10 to communicate with the exterior of the casing 10. The cover portion 60 is configured to cover peripheries of the refrigerant pipe connection portions 15*a* and 15*b*, and cover the outside of the casing 10 with the opening port 50. The air-conditioning apparatus 100 still further includes the refrigerant sensing unit 99 provided in the refrigerant leakage sensing space 99*s* and configured to sense leakage of refrigerant, the refrigerant leakage sensing space 99*s* being made up of the outside space A of the casing 10 and the inside space B of the casing 10, the outside space A being covered by the cover portion 60, the inside space B communicating with the outside space A through the opening port 50. Thus, in the configuration in which the refrigerant pipe connection portions 15*a* and 15*b* are located outside the casing 10 of the indoor unit 1, if refrigerant leaks from the refrigerant pipe connection portions 15*a* and 15*b*, first the leaking refrigerant can flow through the interior of the refrigerant leakage sensing space 99*s* formed by the cover portion 60, so that the refrigerant sensing unit 99 provided in the refrigerant leakage sensing space 99*s* can immediately sense the leakage of the refrigerant.

Figure 7:
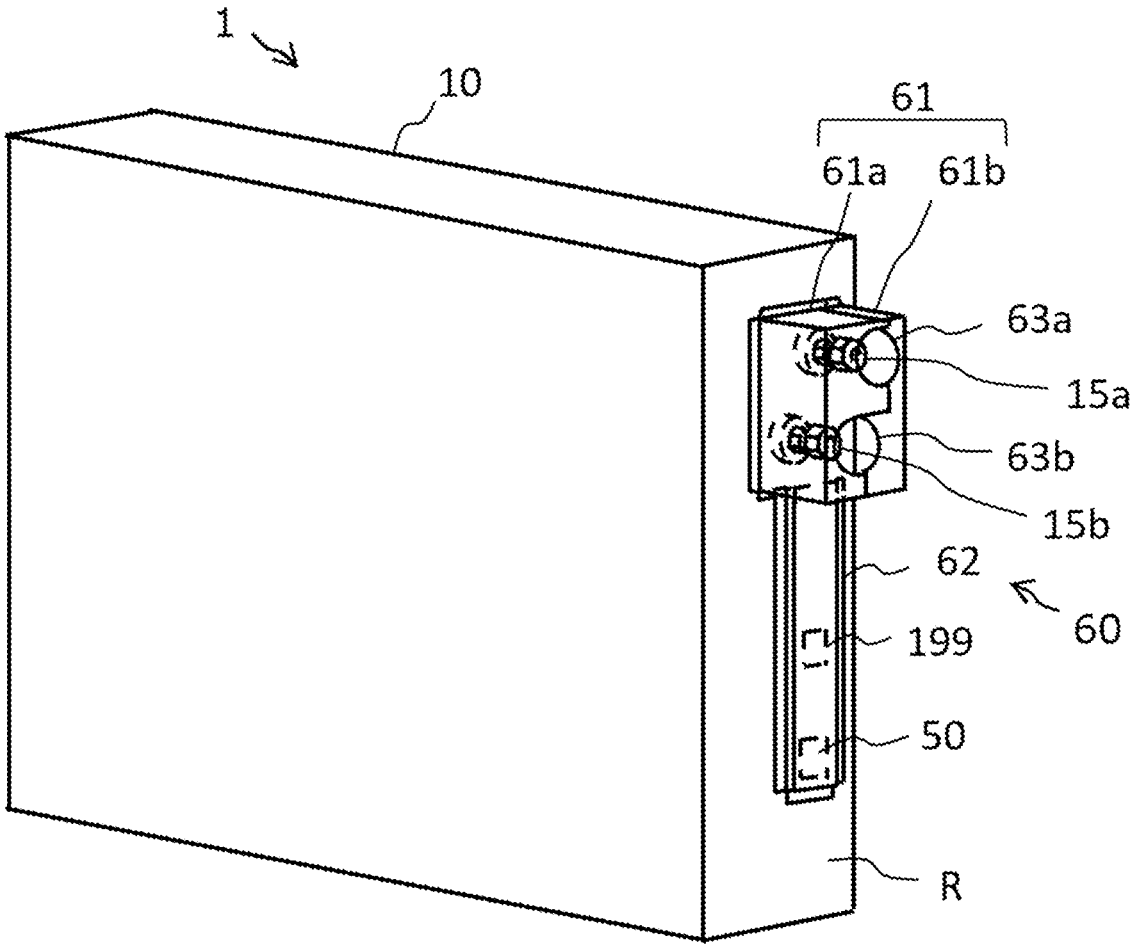
FIG. 7 is a perspective view illustrating a modification of the indoor unit of the air-conditioning apparatus according to the embodiment.

Note that in the above embodiment, the refrigerant sensing unit 99 has been described as being provided in the inside space B of the casing 10. However, the location of the refrigerant sensing unit 99 is not limited to this example. The refrigerant sensing unit 99 may be provided in the outside space A of the casing 10 covered by the cover portion 60 instead of, or in addition to, the inside space B of the casing 10. FIG. 7 is a perspective view illustrating a modification of the indoor unit 1 of the air-conditioning apparatus 100 according to the embodiment. As illustrated in FIG. 7, in a case where a refrigerant sensing unit 199 is provided in the space A covered by the cover portion 60, at the time when leaking refrigerant reaches the refrigerant sensing unit 199 provided within the cover portion 60, the refrigerant sensing unit 199 can sense the leakage. Thus, the leakage of the refrigerant can be sensed relatively quickly.

In the above embodiment, the opening port 50 has been described as being formed at a position on the lower side of the side portion R of the casing 10 located closest to the refrigerant sensing unit 99. However, it suffices that the opening port 50 at least allows the interior of the casing 10 to communicate with the exterior of the casing 10. The position of the opening port 50 is not limited to the above example. Provided that the opening port 50 at least allows the interior of the casing 10 to communicate with the exterior of the casing 10, if refrigerant leaks from the refrigerant pipe connection portions 15*a* and 15*b*, the leaking refrigerant can be guided from the opening port 50 to the interior of the casing 10, so that the refrigerant sensing unit 99 provided in the casing 10 can sense the leakage of the refrigerant. For example, the opening port 50 may be formed on another side portion of the casing 10 other than the side portion R. Further, the opening port 50 may be formed at a position in or around the middle or on the upper side of the casing 10.

Note that it is more preferable to form the opening port 50 at a position on the upstream side of the airflow passage formed in the casing 10 and running through the load-side heat exchanger 7, rather than the downstream side thereof. The reason for this is that when the leaking refrigerant may flow into the casing 10 and enter the airflow passage, the opening port 50 causes this leaking refrigerant to flow toward the upstream side of the airflow passage rather than the downstream side, such that the leaking refrigerant is diluted with air in the casing 10 and then discharged.

In the above embodiment, the left cover 61*a* and the right cover 61*b* making up the first part 61 have been described as both being removably attached to the casing 10. However, either the left cover 61*a* or the right cover 61*b* may only be removable from the casing 10. The reason for this is that when at least either one of them is removable from the casing 10, the process of connecting the extension pipes 12*a* and 12*b* to the refrigerant pipe connection portions 15*a* and 15*b* and other processes can be facilitated. As a means of removably attaching the cover, in addition to the screw fixing, any attachment means can be employed, such as using magnets or hooking a hook-like engagement portion on an engagement hole.

In the above embodiment, the cover portion 60 has been described as being made up of three separable components. However, the cover portion 60 may be made up of a single component into which these components are integrated, or may be made up of two or four or more separable components.

In the above embodiment, an example has been described in which the cover portion 60 has a cuboid shape. However, the shape of the cover portion 60 is not limited to this example. The cover portion 60 may have any shape, for example, a rounded prismatic shape or a hemispherical shape.

In the above embodiment, the configuration of the air-conditioning apparatus according to the present disclosure has been described as being applied to the indoor unit. However, this configuration may also be applied to the outdoor unit. The indoor unit or the outdoor unit, to which the configuration of the air-conditioning apparatus according to the present disclosure is applied, may be mounted on a floor, or may be mounted above a ceiling.

REFERENCE SIGNS LIST

1: indoor unit, 2: outdoor unit, 3: compressor, 4: heat-source-side heat exchanger, 5: pressure reducing device, 7: load-side heat exchanger, 9: internal refrigerant pipe, 10: casing, 21: drain pan, 25: control box, 40: refrigerant circuit, 50: opening port, 60: cover portion, 61: first part, 62: second part, 7*f*: fan, 99, 199: refrigerant sensing unit, 99*s*: refrigerant leakage sensing space, 100: air-conditioning apparatus, 12*a*, 12*b*: extension pipe, 15*a*, 15*b*: refrigerant pipe connection portion, 61*a*: left cover, 61*b*: right cover, 63*a*, 63*b*: through opening port

The invention claimed is:

1. An air-conditioning apparatus comprising:

a refrigerant circuit configured to allow refrigerant to circulate therein;

a casing configured to accommodate therein a heat exchanger and an internal refrigerant pipe, the heat exchanger and the internal refrigerant pipe each forming a part of the refrigerant circuit;

a refrigerant pipe connection portion provided on an outside of one side portion of the casing, and configured to connect the internal refrigerant pipe and an external refrigerant pipe;

an opening port formed as an opening in the one side portion of the casing, and configured to allow an interior of the casing to communicate with an exterior of the casing;

a cover portion configured to cover a periphery of the refrigerant pipe connection portion, cover, from outside of the casing, the opening port, and when refrigerant leaks from the refrigerant pipe connection portion, cause the refrigerant leaking from the refrigerant pipe connection portion to flow along the outside of the casing to the opening port; and a refrigerant sensing unit provided in a refrigerant leakage sensing space, and configured to sense leakage of the refrigerant, the refrigerant leakage sensing space being made up of an outside space of the casing and an inside space of the casing, the outside space being covered by the cover portion, the inside space communicating with the outside space through the opening port.

2. The air-conditioning apparatus of claim 1, wherein the refrigerant sensing unit is provided in the inside space of the casing in the refrigerant leakage sensing space, and the opening port is formed on a side portion of the casing located closest to the refrigerant sensing unit or on a side portion of the casing located second closest to the refrigerant sensing unit.

3. The air-conditioning apparatus of claim 1, wherein the refrigerant sensing unit is provided in the outside space of the casing in the refrigerant leakage sensing space, the outside space being covered by the cover portion.

4. The air-conditioning apparatus of claim 1, wherein the cover portion includes a first part and a second part, the first part being configured to cover the periphery of the refrigerant pipe connection portion, the second part being configured to cover, from outside of the casing, the opening port.

5. The air-conditioning apparatus of claim 4, wherein the first part is made up of at least two divided pieces divided from a section through which the external refrigerant pipe penetrates.

6. The air-conditioning apparatus of claim 5, wherein the first part includes a left cover and a right cover as the two divided pieces divided into left and right, and the left cover and the right cover are attached to the casing in such a manner that either one of the left cover and the right cover is removable from the casing.

7. The air-conditioning apparatus of claim 4, wherein the opening port is formed at a position below the first part.

8. The air-conditioning apparatus of claim 4, wherein the second part is a vertically elongated part attached to the one side portion of the casing, and the second part has an open upper end portion connected to the first part and a closed lower end portion covering the outside of the casing with the opening port.

9. The air-conditioning apparatus of claim 8, wherein when the cover portion causes the refrigerant leaking from the refrigerant pipe connection portion to flow along the outside of the casing to the opening portion, the refrigerant flows through a space formed by the second part.

* * * * *